US006579214B2

(12) United States Patent
Crump

(10) Patent No.: US 6,579,214 B2
(45) Date of Patent: Jun. 17, 2003

(54) GOLFING EXERCISE MACHINE

(75) Inventor: Anthony M. Crump, Virginia Beach, VA (US)

(73) Assignee: Anthony M Crump, VA. Beach, VA (US)

( * ) Notice: Subject to any disclaimer, the term of this patent is extended or adjusted under 35 U.S.C. 154(b) by 0 days.

(21) Appl. No.: 10/077,533

(22) Filed: Feb. 15, 2002

(65) Prior Publication Data

US 2002/0111251 A1 Aug. 15, 2002

Related U.S. Application Data

(63) Continuation-in-part of application No. 09/667,078, filed on Feb. 9, 2001, now abandoned.

(51) Int. Cl.[7] ..... A63B 2/062
(52) U.S. Cl. ..... 482/103
(58) Field of Search ..... 482/94, 95, 96, 482/98, 100, 102, 99, 101, 103, 109, 122, 123, 129, 130, 133, 138, 139; 434/252; 473/282, 131, 219, 226, 229, 231, 256, 257, 422, 437; 211/70.2; D21/791; 273/108.2, 174

(56) References Cited

U.S. PATENT DOCUMENTS 404,802 A * 6/1889 Sleeper ..... 482/102
2,848,234 A * 8/1958 Brandon ..... 473/229
3,306,611 A * 2/1967 Gaul ..... 482/103
3,462,156 A * 8/1969 Gentry ..... 473/229
3,708,167 A * 1/1973 Potgieter ..... 482/100
3,966,203 A * 6/1976 Bickford ..... 482/103
4,135,714 A * 1/1979 Hughes ..... 482/127
4,229,002 A * 10/1980 Masters ..... 482/94
4,902,006 A * 2/1990 Stallings, Jr. ..... 482/99
4,988,095 A * 1/1991 Ferrari ..... 482/102
5,007,635 A * 4/1991 Tiller ..... 482/129
5,156,402 A * 10/1992 Hart ..... 473/229
5,158,299 A * 10/1992 Otter ..... 473/229
5,221,245 A * 6/1993 Yeh ..... 482/138
5,242,344 A 9/1993 Hundley
5,336,149 A * 8/1994 Wang ..... 482/100
5,466,204 A 11/1995 Nearing
5,478,079 A * 12/1995 Liberatore et al. ..... 473/229
5,820,529 A 10/1998 Weintraub
5,893,818 A 4/1999 Zahiri et al.
6,027,429 A 2/2000 Daniels

* cited by examiner

*Primary Examiner*—Nicholas D. Lucchesi
*Assistant Examiner*—Victor K. Hwang
(74) *Attorney, Agent, or Firm*—Anthony M Crump

(57) ABSTRACT

A golf exercising and training apparatus for varying the resistance of a hand hold bar is disclosed. The apparatus comprises an L-shaped member(s) that transfers resistance via a plurality of pulleys and a cable from a stack of weights to the hand hold bar. Two strike lines are provided on an artificial turf for accommodating both right and left-handed users.

20 Claims, 6 Drawing Sheets

GOLFING EXERCISE MACHINE

This is a continuation-in-part application claiming priority from patent application Ser. No. 09/667,078 filed on Feb. 9, 2001, now abandoned.

STATEMENT REGARDING FEDERALLY SPONSORED RESEARCH AND DEVELOPMENT

Not Applicable

BACKGROUND OF THE INVENTION

This invention relates to the field of exercise equipment. More particularly, the present invention is drawn towards an exercise machine that uses weights and pulley systems for strength training. By employing weights to provide resistance to a user's exercise movement, the present invention exercises various muscle groups of the user's body.

Many weight training devices are used to target a selected group of muscles in athletes. These weight training devices have made modern athletes faster and stronger than their predecessors. It has been realized that strength conditioning of selected muscle groups can greatly enhance an athlete's performance.

U.S. Pat. No. 5,242,344 to Hundley discloses a limb movement exercising and training apparatus. The apparatus is equipped with a weight rack and accompanying plates for providing adjustable resistance. The resistance is controlled to provide a relatively large resistance during a first portion of a limb motion and a relatively small resistance during a second portion of the limb motion.

Athletes are various shapes and sizes. Moreover, limb motion among athletes varies greatly. The Hundley machine is rigid in form and requires a user to follow the designed motion of rotation of the machine. Thus, many users may find that the Hundley machine does not suit their needs for strengthening limb motion.

BRIEF SUMMARY OF THE INVENTION

The present invention is a tube steel constructed machine comprising a standing platform. The platform is covered with indoor/outdoor carpet having two strike lines thereupon. The strike lines indicate left and right handed golf pattern swings. A user points the handhold bar towards these lines while using the machine to parrot a golf swing.

The machine further comprises a stationary frame that includes a vertical member. A sub-frame is connected to the vertical member via a sleeve. Thus, either the vertical member or the sub-frame is sleeved onto the other. The vertical member and the sub-frame are connected together with a hitch pin and bolt for stability.

A swing stabilizer is uniquely designed to control movement of the cable. A handhold bar is connected to one end of a cable. The cable is snaked through an array of pulleys and connected at a second end to a weight selector bar. The weight selector bar is designed to allow a user to quickly vary the resistive effect of the handhold bar.

It is an object of the present invention to provide a machine that accommodates various limb motions from a multitude of users.

It is another object of the invention to provide a machine that can be used to strengthen the torso muscles of a golfer. By strengthening the torso muscles, the golfer can add distance to his drive on a golf course.

It is a further object of the invention to provide a machine that strength trains other muscles essential for playing golf such as wrist and forearm muscles used in gripping a golf club.

It is another object of the invention to provide a machine that can be easily moved and quickly disassembled for storage in a garage or other room having a low ceiling.

The embodiments of the present invention presented hereinafter are merely exemplary of the invention. The present invention may be embodied in various configurations. It is to be understood that the specific structural and functional details disclosed in the following embodiments are not to be interpreted as limiting, rather they are the basis for the claims and are to be used to teach a skilled artisan of the art how to practice the invention.

DETAILED DESCRIPTION

It is to be understood that the invention is not limited to the exact construction illustrated and described herein, but that various changes and modifications may be made without departing from the spirit and the scope of the invention as defined in the claims presented at the end of the detailed description.

Figure 1:
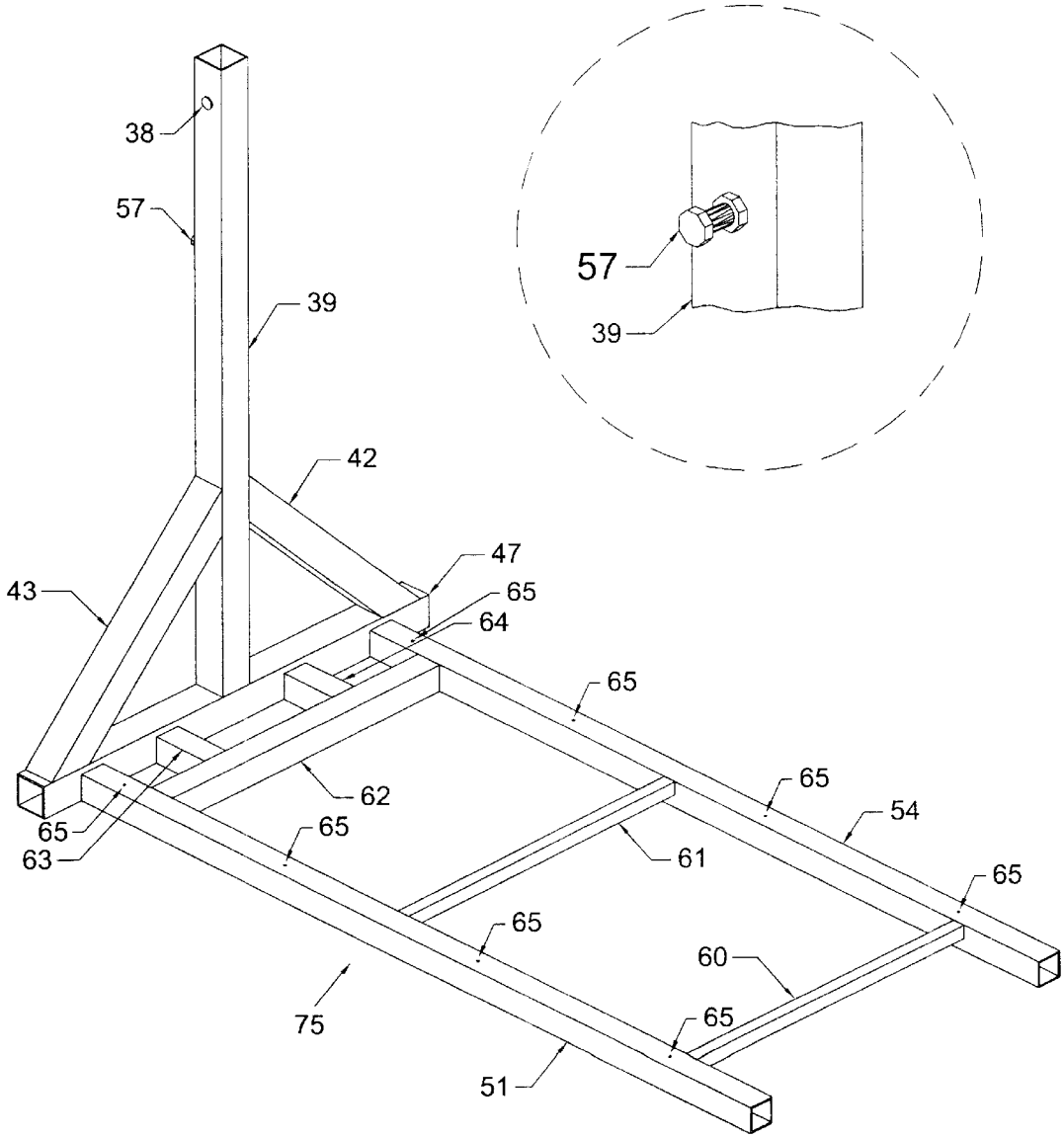
FIG. 1 is a view of the stationary frame or base of the machine.

FIG. 1 is a view of the stationary frame 75 for machine 100. The stationary frame 75 comprises outer stationary frame members 51 and 54. The stationary frame members 51 and 54 typically comprise tube steel. However, other suitable known materials such as composites, aluminum, etc. may be substituted so long as they are lightweight and durable.

Lateral support members 60, 61 and 62 connect stationary frame member 51 to stationary frame member 54 and provide stability. The lateral support members may be bolted to the stationary frame members. Alternatively, they may be welded together or connected via known methods. Weight landing members 63 and 64 are attached between the base of the vertical member 47 and lateral support member 62. The weight landing members 63 and 64 add structural integrity to stationary frame 75. The weight landing members 63 and 64 also provide a surface upon which weight landing pad 49 rests, as discussed below.

Holes 65 are provided in each outer stationary frame member for receiving platform screws. Angled support members 42 and 43 are connected between base 47 and vertical support member 39 to enhance the structural integrity of the stationary base 75. A securing bolt 57 passes through vertical support member 39 for affixing a portion of the sub-frame 31.

Figure 2:
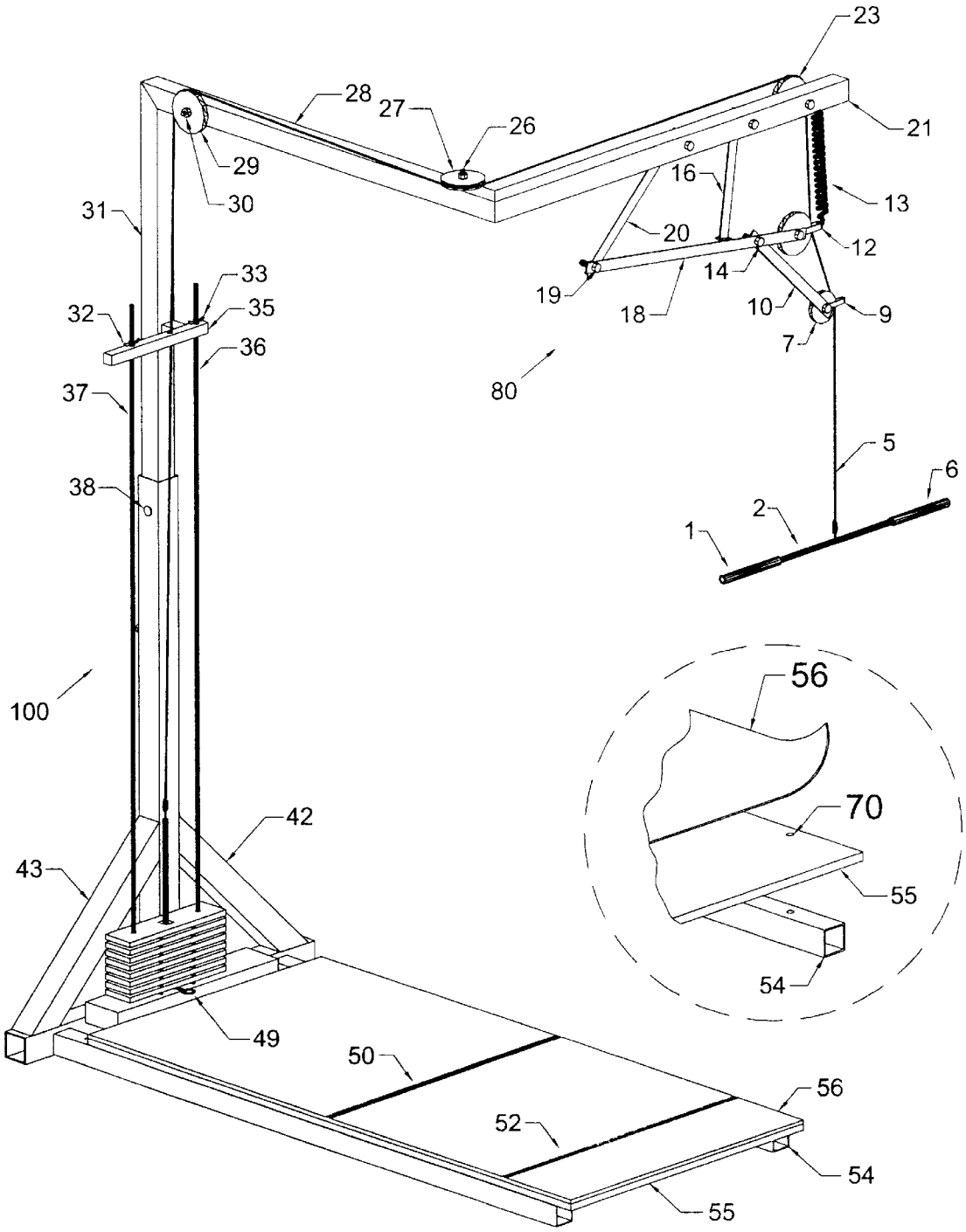
FIG. 2 is a side elevation view of the exercise machine.

FIG. 2 is a side elevation view of the exercise machine 100. The platform 55 is coupled with outer stationary frame members 51 and 54 via bolts or screws which pass through holes 70. Indoor/outdoor carpet 56 is affixed to platform 55 via an adhesive (not shown). Other known methods may be substituted for the adhesive, for example hook and latch attachment means.

Indoor/outdoor carpet 56 is shown with two parallel strike lines 50 and 52. The parallel strike lines 50 and 52 indicate where the free end of the handhold bar 2 should be pointed during operation. The parallel strike lines 50 and 52 are used by left-handed and right-handed golfers, respectively.

A sub-frame is comprised of vertical extension member 31 and horizontal extension members 21 and 28. The sub-frame is typically made of tube steel or other light-weight durable material. The members 21, 28 and 31 may be welded together or affixed to one another by other known methods. In the preferred embodiment, vertical extension member 31 has an outer diameter that is smaller than the inner diameter of vertical support member 39. Thus, vertical support member 39 has a sleeve for accepting a portion of vertical extension member 31. Vertical extension member 31 slides into vertical support member 39 and is secured by hitch pin 38 and securing bolt 57. Thus, the machine 100 may quickly be disassembled for storage purposes. Pulleys 29, 27 and 23 are attached to horizontal extension members 21 and 28 via bolts 30, 26 and 22.

The cable 5 is attached at one end to a stack of weights as discussed below. The cable 5 is routed through pulleys 7, 11, 23, 27 and 29. An opposite end of cable 5 is connected to handhold bar 2.

Figure 3:
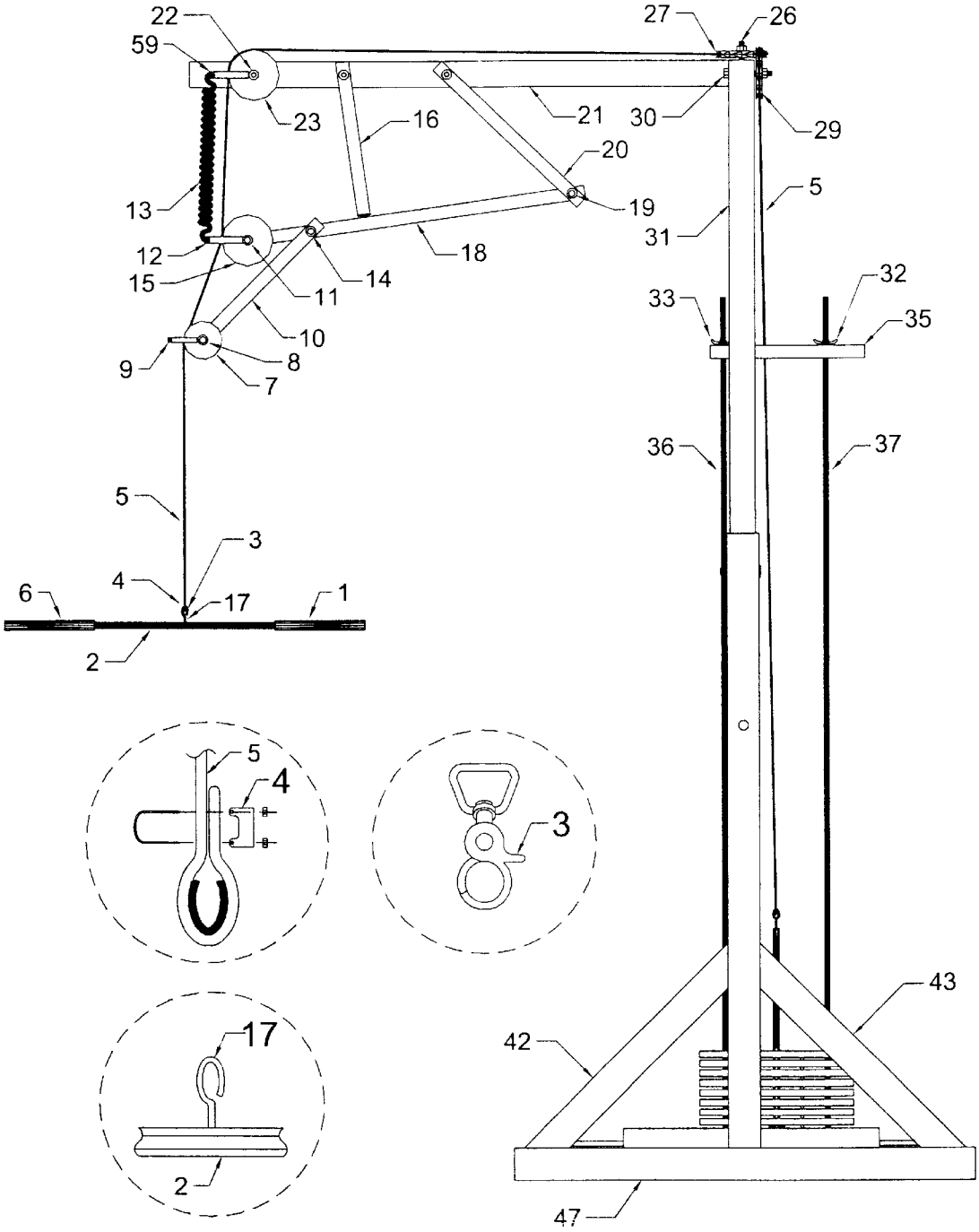
FIG. 3 is a detailed back plane view of the apparatus showing the cable stabilizer, working members and cable connection to the handhold bar.

FIG. 3 is a back plane view of the apparatus showing a detailed view of the cable stabilizer 80. The stabilizer arm 20 is coupled to horizontal extension member 21 at one end via bolt 25. An opposite end of stabilizer arm 20 is connected to control arm 18 via bolt 19. The stop arm 16 is coupled to horizontal extension member 21 via bolt 24. When not in operation, control arm 18 rests against stop arm 16 via the biasing force provided by spring 13. Other known methods may be employed for biasing control arm 18 towards stop arm 16. For example, a counter weight or other device may be used to bias the control arm 18 towards the stop arm 16. The pulley 15 is connected to an end of control arm 18 via bolt 11. The bolt 11 also secures pulley guide 12 to control arm 18.

Pulley 23 is connected to horizontal extension member 21 via bolt 22. The bolt 22 also secures pulley guide 59. Spring 13 is shown as being connected to pulley guide 59 and pulley guide 12. However, the spring 13 may be coupled between any portion of the cable stabilizer and horizontal extension member 21 such that control arm 18 is biased to rest against stop arm 16 when the machine 100 is not in use.

Control arm 10 is connected to control arm 18 via bolt 14. Pulley 7 is connected to control arm 10 at an end opposite the end connected to control arm 18. A bolt 8 connects pulley guide 9 and pulley 7 to control arm 10.

Cable 5 is linked by cable thimble 4 to snap hook 3 which connects to eye hook 17 on handhold bar 2. Breakout views are provided for each of these elements. It should be noted that various other methods of connecting cable 5 to handhold bar 2 are known. These known methods may be substituted without deviating from the spirit of this invention.

Figure 4:
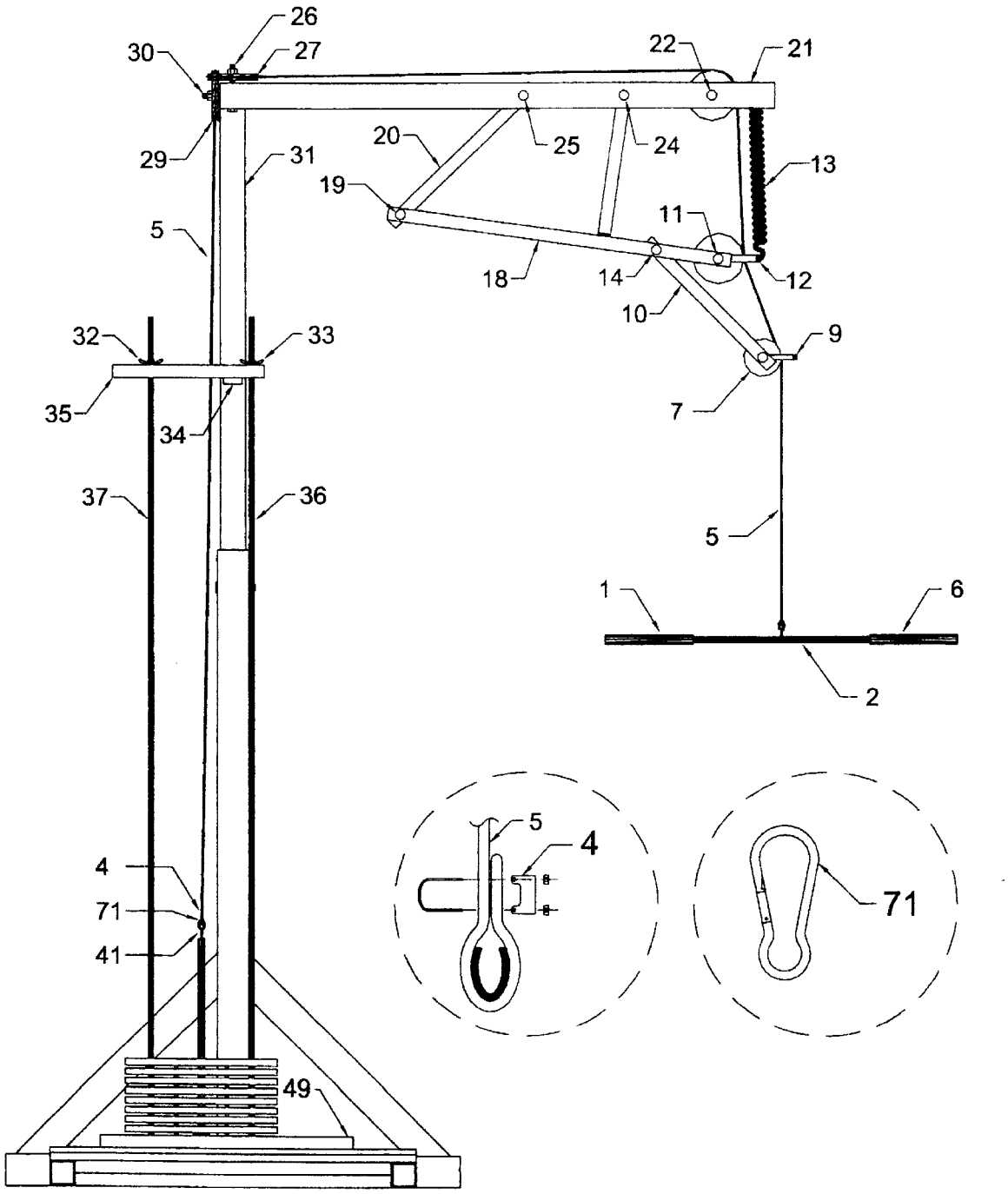
FIG. 4 is a front plane view showing the weights, working members and the cable connection to the weight selector bar.

FIG. 4 is a front plane view showing the weights 46 and the cable connection to the weight selector bar 67. Weights 46 rest upon weight landing pad 49 which is coupled to weight landing members 63 and 64 as shown in FIG. 1. A guide rod bracket 35 is typically welded to a spacer 34 which is connected to vertical extension member 31. Guide rods 36 and 37 pass through holes in weights 46 and ensure that weights 46 are moved in a vertical manner only. In the preferred embodiment, guide rods 36 and 37 pass through guide rod bracket 35 and wing nuts 32 and 33 are affixed thereto. However, guide rod bracket 35 may comprise indentations rather than holes for receiving an end of rods 36 and 37. Thus, the need for wing nuts 32 and 33 may be eliminated. A second end of cable 5 comprises a loop as shown in the breakout view. A D-ring or carabineer 71 connects to the loop and affixes a weight selector bar 67 via eye hook 41.

Figure 5:
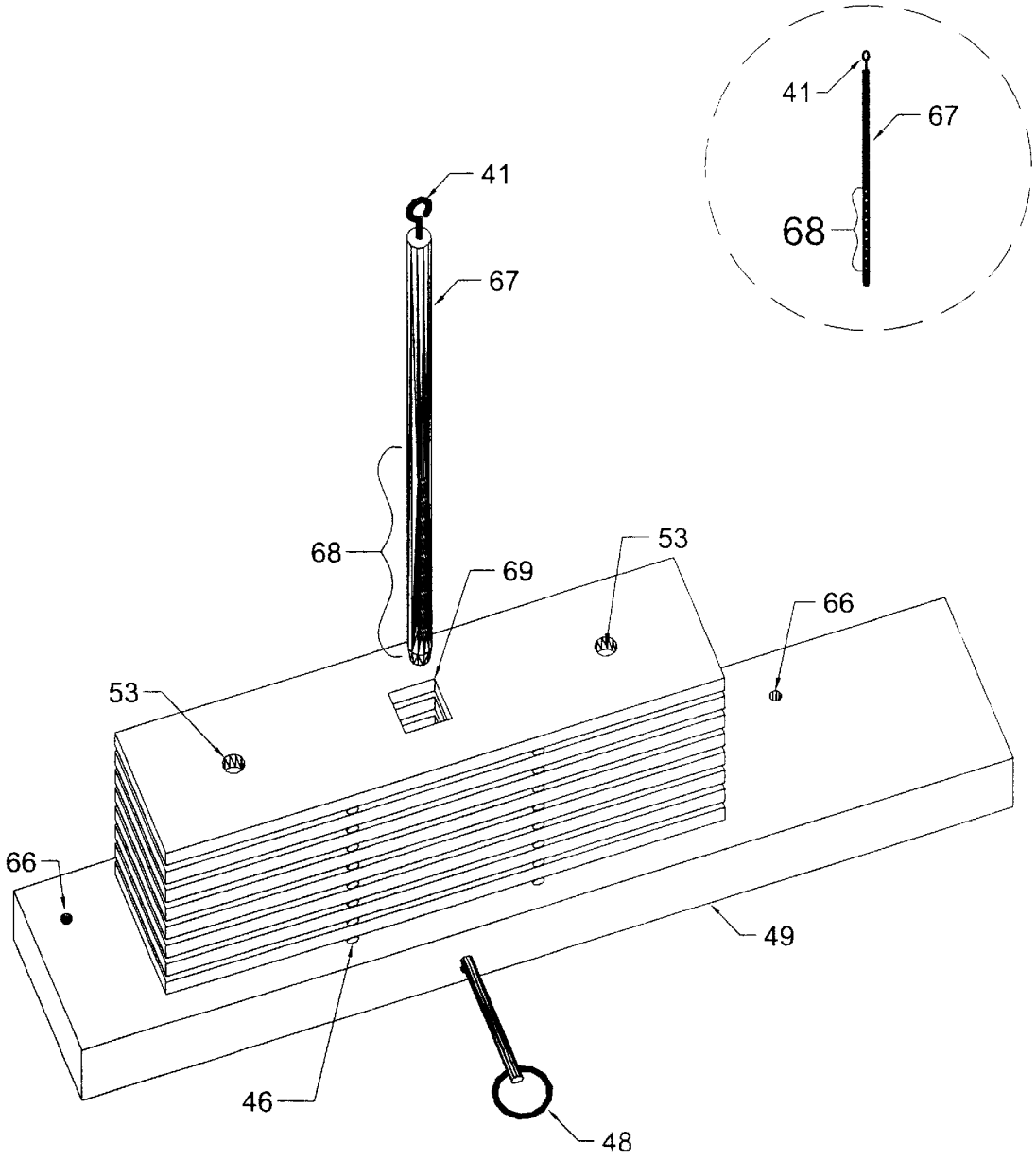
FIG. 5 is a detailed elevation of the weight, weight selector bar and the spring ball pin used as the selector.

FIG. 5 is a detailed elevation of the weights 46, weight selector bar 67 and the spring ball pin 48 used to vary the resistance of the handhold bar 2. Screws or bolts (not shown) pass through holes 66 to secure weight landing pad 49 to weight landing member 63 and 64. Weights 46 comprise holes 53 for receiving guide rod members 36 and 37. Hole 69 in weights 46 receives selector bar 67. Selector bar 67 comprises holes 68 for varying the amount of resistance on the handhold bar 2.

It should be noted that various types of weights could be employed for practicing the invention. The weight means could be accomplished by several different methods. For example, hydraulic means, resistive bands, electrical resistive means or force means such as a fluid filled piston connected to an end of the cable for providing resistance training.

Figure 6:
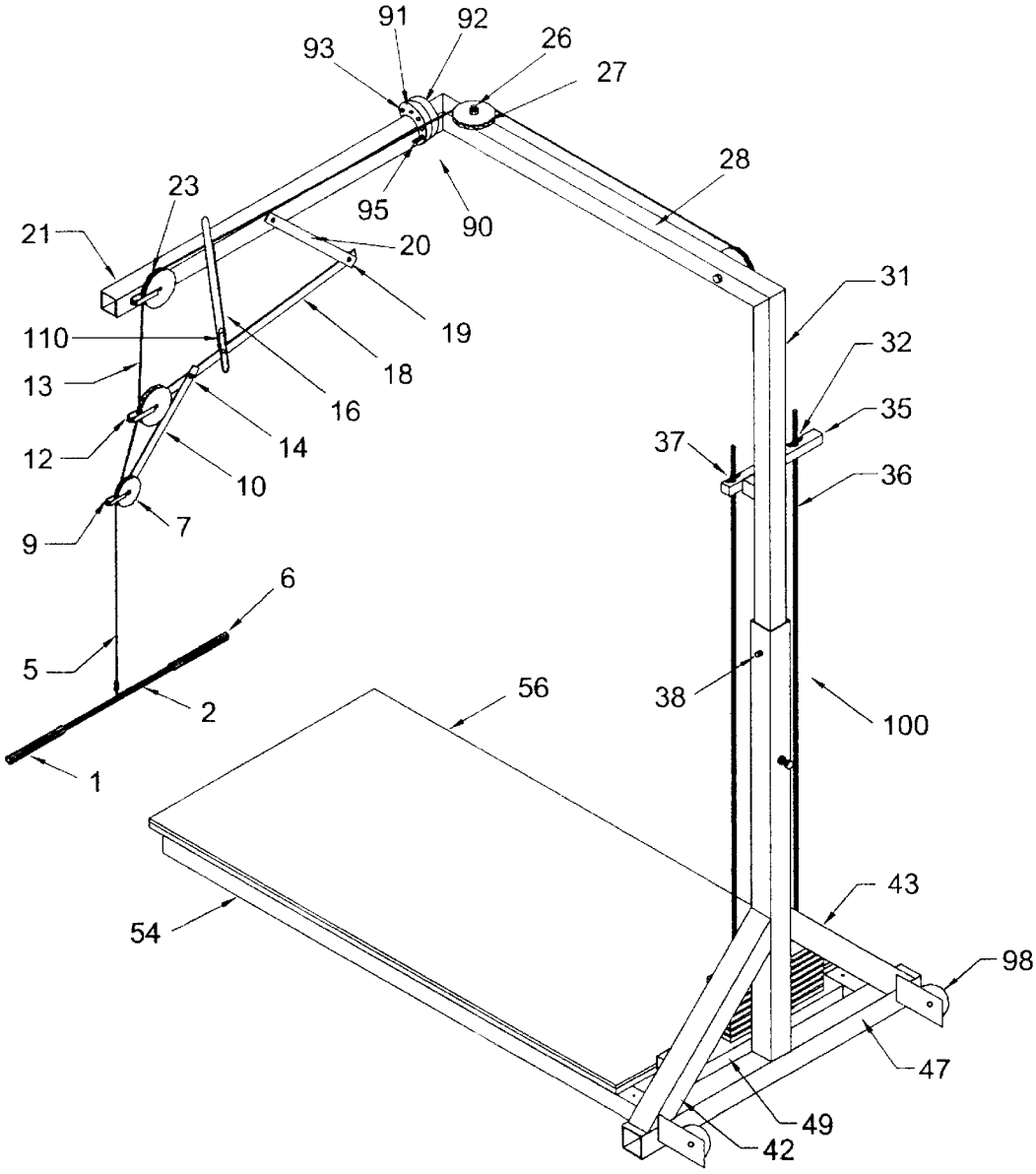
FIG. 6 is a detailed elevation view of the machine having an adjustable horizontal extension member.

FIG. 6 shows a modified version of the cable stabilizer 80 discussed above with respect to FIG. 2. The stop arm 16 comprises a slot 110 and is coupled to control arm 18. In this embodiment, the horizontal extension member 21 is adjustable via adjustment means 90. Two complementary circular flanges 91 and 92 couple horizontal extension member 21 together. One flange is equipped with an extended portion, while the other flange has a recessed portion for receiving the extended portion. A plurality of holes 93 is provided in flange 91. The other flange 92 is equipped with a single hole. Pin 95 is used to adjust the horizontal extension member 21 to various angled positions. Machine 100 is also equipped with wheels 98 for ease in moving it. Spring 13 is not shown in FIG. 6 for ease in understanding the drawing.

It is to be understood that the invention is not limited to the exact construction illustrated and described above. Various changes and modifications may be made without departing from the spirit and the scope of the invention as defined in the following claims.

I claim:

1. A golf exercise apparatus comprising;

a base;

a vertical support member having a bottom end connected to an end of said base;

at least one horizontal extension member having a proximal end connected to a top end of said vertical support member opposite said base and extending above said base;

a cable stabilizer control means connected to a distal end of said at least one horizontal extension member;

a cable operatively engaging said cable stabilizer means;

said cable stabilizer control means comprising a control arm pivotally connected to said at least one horizontal extension member, a stop arm mounted to said at least one horizontal extension member, a biasing means for biasing said control arm into resting engagement with said stop arm, and at least one pulley supported on said control arm to operatively engage said cable; and a handhold bar connected to one end of said cable and a selective exercise resistance connected to an opposite end of said cable, wherein an upright user grasps said handhold bar and moves said handhold bar against the selected exercise resistance in a golf swing movement.

2. The golf exercise apparatus of claim 1, wherein said at least one horizontal extension member comprises a first horizontal extension member connected to said vertical support member; and a second horizontal extension member connected to an end of said first horizontal extension member opposite said vertical support member.

3. The golf exercise apparatus of claim 2, wherein said second horizontal extension member extends from said first horizontal extension member at an angle.

4. The golf exercise apparatus of claim 3, wherein said angle is substantially orthogonal so that said first and second horizontal extension members form an L-shape.

5. The golf exercise apparatus of claim 2, wherein said first and second horizontal extension members are adjustably connected so that said cable stabilizer control means is selectively positioned relative to said first horizontal extension member.

6. The golf exercise apparatus of claim 5, wherein said first and second horizontal extension members are adjustably connected by a pair of complementary flanges, each flange having at least one hole for selective coupling.

7. The golf exercise apparatus of claim 1, wherein said biasing means comprises a spring.

8. The golf exercise apparatus of claim 7, wherein said spring has a first end connected to a distal end of said control arm and said spring has a second end connected to the distal end of said at least one horizontal extension member.

9. The golf exercise apparatus of claim 1, wherein said at least one pulley supported on said control arm comprises a first pulley and a second pulley.

10. The golf exercise apparatus of claim 1, wherein said stop arm further comprises a slot, and said control arm engages said slot.

11. The golf exercise apparatus of claim 1, wherein said exercise resistance comprises a selective weight resistance.

12. The golf exercise apparatus of claim 11, wherein said selective weight resistance comprises a weight stack.

13. The golf exercise apparatus of claim 1, wherein said base comprises a platform for supporting the user.

14. The golf exercise apparatus of claim 13, wherein said platform further comprises a pair of parallel strike lines.

15. The golf exercise apparatus of claim 1, wherein said vertical support member includes a height adjustment means for adjusting a vertical position of said at least one horizontal extension member.

16. The golf exercise apparatus of claim 1, wherein said base further comprises at least one wheel for supporting the apparatus for ease of transport.

17. The golf exercise apparatus of claim 1, wherein said at least one horizontal extension member supports a plurality of pulleys for guiding said cable to said cable stabilizer control means.

18. A golf exercise apparatus comprising;

a base;

a vertical support member having a bottom end connected to an end of said base;

a first horizontal extension member having a proximal end connected to a top end of said vertical support member opposite said base and extending above said base;

a second horizontal extension member connected to a distal end of said first horizontal extension member and extending therefrom at an angle to said first horizontal extension member;

said first and second horizontal extension members are adjustably connected so that said cable stabilizer control means is selectively positioned relative to said first horizontal extension member;

a cable stabilizer control means connected to a distal end of said at least one horizontal extension member;

a cable guided by a plurality of pulleys mounted on said horizontal extension members to operatively engage said cable stabilizer means;

said cable stabilizer control means comprising a control arm pivotally connected to said at least one horizontal extension member, a stop arm mounted to said at least one horizontal extension member, a spring biasing means for biasing said control arm into resting engagement with said stop arm, and a pair of pulleys supported on said control arm to operatively engage said cable; and a handhold bar connected to one end of said cable and a selective weight resistance connected to an opposite end of said cable, wherein an upright user grasps said handhold bar and moves said handhold bar against the selected weight resistance in a golf swing movement.

19. The golf exercise apparatus of claim 18, wherein said base comprises a platform for supporting the upright user.

20. The golf exercise apparatus of claim 18, wherein said base further comprises at least one wheel for supporting said apparatus for ease of transport.

* * * * *